US006655914B2

(12) United States Patent
Miyazaki et al.

(10) Patent No.: US 6,655,914 B2
(45) Date of Patent: Dec. 2, 2003

(54) CASING COVER AND PUMP DEVICE

(75) Inventors: Yoshiaki Miyazaki, Tokyo (JP); Hiroshi Uchida, Tokyo (JP); Kenichi Kajiwara, Tokyo (JP)

(73) Assignee: Ebara Corporation, Tokyo (JP)

( * ) Notice: Subject to any disclaimer, the term of this patent is extended or adjusted under 35 U.S.C. 154(b) by 0 days.

(21) Appl. No.: 10/183,551

(22) Filed: Jun. 28, 2002

(65) Prior Publication Data

US 2003/0003002 A1 Jan. 2, 2003

(30) Foreign Application Priority Data

Jul. 2, 2001 (JP) ..... 2001-200766

(51) Int. Cl.[7] ..... F04D 29/62

(52) U.S. Cl. ..... 415/214.1; 415/196; 415/206; 417/423.11; 277/630; 277/637; 277/642

(58) Field of Search ..... 415/214.1, 170.1, 415/196, 203, 204, 206, 174.2; 277/628, 630, 637, 641, 642; 417/423.11, 423.15

(56) References Cited

U.S. PATENT DOCUMENTS 5,310,310 A 5/1994 Nakatsukasa et al.

FOREIGN PATENT DOCUMENTS

DE 2011536 A * 10/1970 ..... 415/206

* cited by examiner

*Primary Examiner*—Christopher Verdier
(74) *Attorney, Agent, or Firm*—Armstrong, Westerman & Hattori, LLP

(57) ABSTRACT

A casing cover is used in separating a motor assembly and a pump assembly from each other in a pump device. The casing cover has a cylindrical wall portion having a motor-side positioning portion disposed on one of an inner and outer circumferential surface of the cylindrical wall portion for being fitted to a member of the motor assembly, and a pump-side positioning portion disposed on the other of an inner and outer circumferential surface of the cylindrical wall portion for being fitted to a member of the pump assembly.

6 Claims, 2 Drawing Sheets

CASING COVER AND PUMP DEVICE

BACKGROUND OF THE INVENTION

1. Field of the Invention

The present invention relates to a casing cover for use in separating a motor assembly and a pump assembly from each other in a pump device such as a circulating pump for handling fresh water, and a pump device having such a casing cover.

2. Description of the Related Art

Pump devices such as a circulating pump for handling fresh water are required to prevent the liquid that is being handled under an increased pressure in a pump casing from leaking out of a high-pressure opening in the pump casing into a motor assembly. To meet such a requirement, it has widely been customary to separate a motor assembly and a pump assembly from each other with a casing cover with a mechanical seal mounted therein for sealing a main shaft and also to seal the pump casing in a water-tight fashion with an O-ring, for example.

FIG. 1 of the accompanying drawings shows, in enlarged fragmentary cross section, a fixed region of a casing cover in a conventional general pump device, the casing cover being formed by pressing a stainless steel plate, for example. The casing cover, generally denoted by 10, has a flat panel portion 12, a cylindrical wall portion 14, and a flange portion 16 which are integrally formed by pressing a flat plate. The cylindrical wall portion 14 has an inner circumferential surface serving as a motor-side faucet-joint surface (motor-side positioning portion) 14*a* held against a motor bracket 20 and an outer circumferential surface serving as a pump-side faucet-joint surface (pump-side positioning portion) 14*b* held against a pump casing 22. The motor-side faucet-joint surface 14*a,* i.e. the motor-side register fit surface 14*a,* is fitted over the motor bracket 20, and the pump-side faucet-joint surface 14*b,* i.e. the pump-side register fit surface 14*b,* is fitted in the pump casing 22, providing a faucet-joint structure, i.e. a socket-and-spigot joint (positioning) structure.

Since the inner and outer circumferential surfaces of the cylindrical wall portion 14 are fitted over and in the motor bracket 20 and the pump casing 22, when the flat plate is pressed to form the cylindrical wall portion 14, one of the inner and outer circumferential surfaces of the cylindrical wall portion 14, e.g., the inner circumferential surface, is used as a dimensional reference to achieve desired dimensional accuracy.

However, in the conventional casing cover 10, when the flat plate is pressed to form the cylindrical wall portion 14, one of the inner and outer circumferential surfaces of the cylindrical wall portion 14, e.g., the inner circumferential surface, is used as a dimensional reference, since the flat plate generally suffers thickness variations, it is difficult to achieve desired dimensional accuracy for the other of the inner and outer circumferential surfaces of the cylindrical wall 14, e.g., the outer circumferential surface. Furthermore, when the pump device is serviced for maintenance, e.g., when the mechanical seal is replaced, because the casing cover 10 tends to stick to the motor bracket 20 and the pump casing 22 due to rust or the like, it is difficult to remove the casing cover 10 while both the inner and outer circumferential surfaces of the cylindrical wall portion 14 are being of normal dimensions.

SUMMARY OF THE INVENTION

It is therefore an object of the present invention to provide a casing cover which is capable of fitting with members of both a motor assembly and a pump assembly highly accurately in providing a faucet-joint (positioning) structure, and of disassembling and removing a member thereof held in interfitting faucet-joint (positioning) engagement with the members of the motor assembly and the pump assembly while keeping normal dimensions, and a pump device having such a casing cover.

According to the present invention, there is provided a casing cover for use in separating a motor assembly and a pump assembly from each other in a pump device, comprising: a cylindrical wall portion having a step, a motor-side positioning portion positioned on one side of the step for being fitted to a member of the motor assembly, and a pump-side positioning portion positioned on the other side of the step for being fitted to a member of the pump assembly.

Since the motor-side positioning portion and the pump-side positioning portion are individually positioned one on each side of the step of the cylindrical wall portion, the casing cover can be formed by pressing a flat plate using both the motor-side positioning portion and the pump-side positioning portion as dimensional references, both the motor-side positioning portion and the pump-side positioning portion can be formed to shape with high dimensional accuracy. The casing cover with such high dimensional accuracy can be assembled easily and quickly in the pump device, and can be disassembled and removed while the motor-side positioning portion and the pump-side positioning portion are being dimensionally maintained.

The motor-side positioning portion may comprise a motor-side faucet-joint surface, and the pump-side positioning portion may comprise a pump-side faucet-joint surface, thereby providing a faucet-joint structure.

The motor-side faucet-joint surface may be disposed on one of an inner and outer circumferential surface of the cylindrical wall portion, and the pump-side faucet-joint surface may be disposed on the other of the inner and outer circumferential surface of the cylindrical wall portion.

According to the present invention, there is also provided a pump device comprising: a motor assembly; a pump assembly; and a casing cover separating the motor assembly and the pump assembly from each other; the casing cover comprising a cylindrical wall portion having a step, a motor-side positioning portion positioned on one side of said step for being fitted to a member of the motor assembly, and a pump-side positioning portion positioned on the other side of said step for being fitted to a member of the pump assembly.

The above and other objects, features, and advantages of the present invention will become apparent from the following description when taken in conjunction with the accompanying drawings which illustrate a preferred embodiment of the present invention by way of example.

DETAILED DESCRIPTION OF THE PREFERRED EMBODIMENTS

Figure 1:
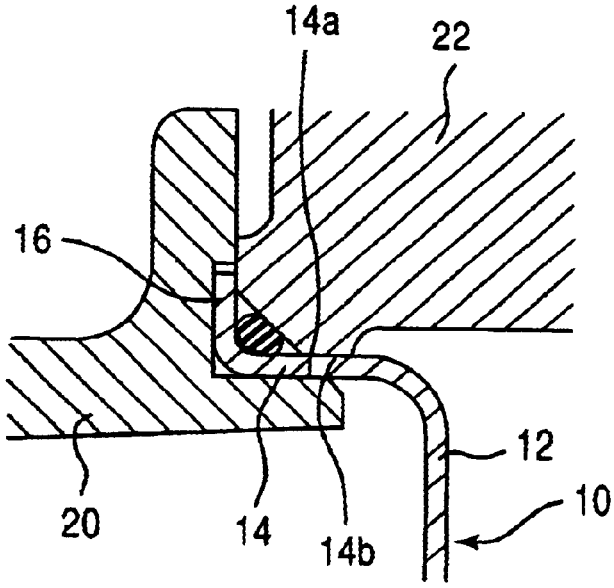
FIG. 1 PRIOR ART
FIG. 1 is an enlarged fragmentary cross-sectional view of a faucet-joint (positioning) structure in a conventional pump device.
Figure 3:
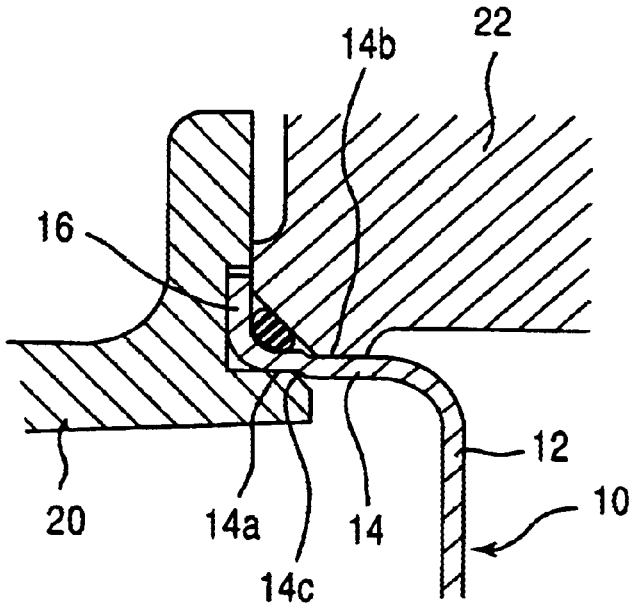
FIG. 3 is an enlarged fragmentary cross-sectional view of a faucet-joint (positioning) structure in the pump device shown in FIG. 2.
Figure 2:
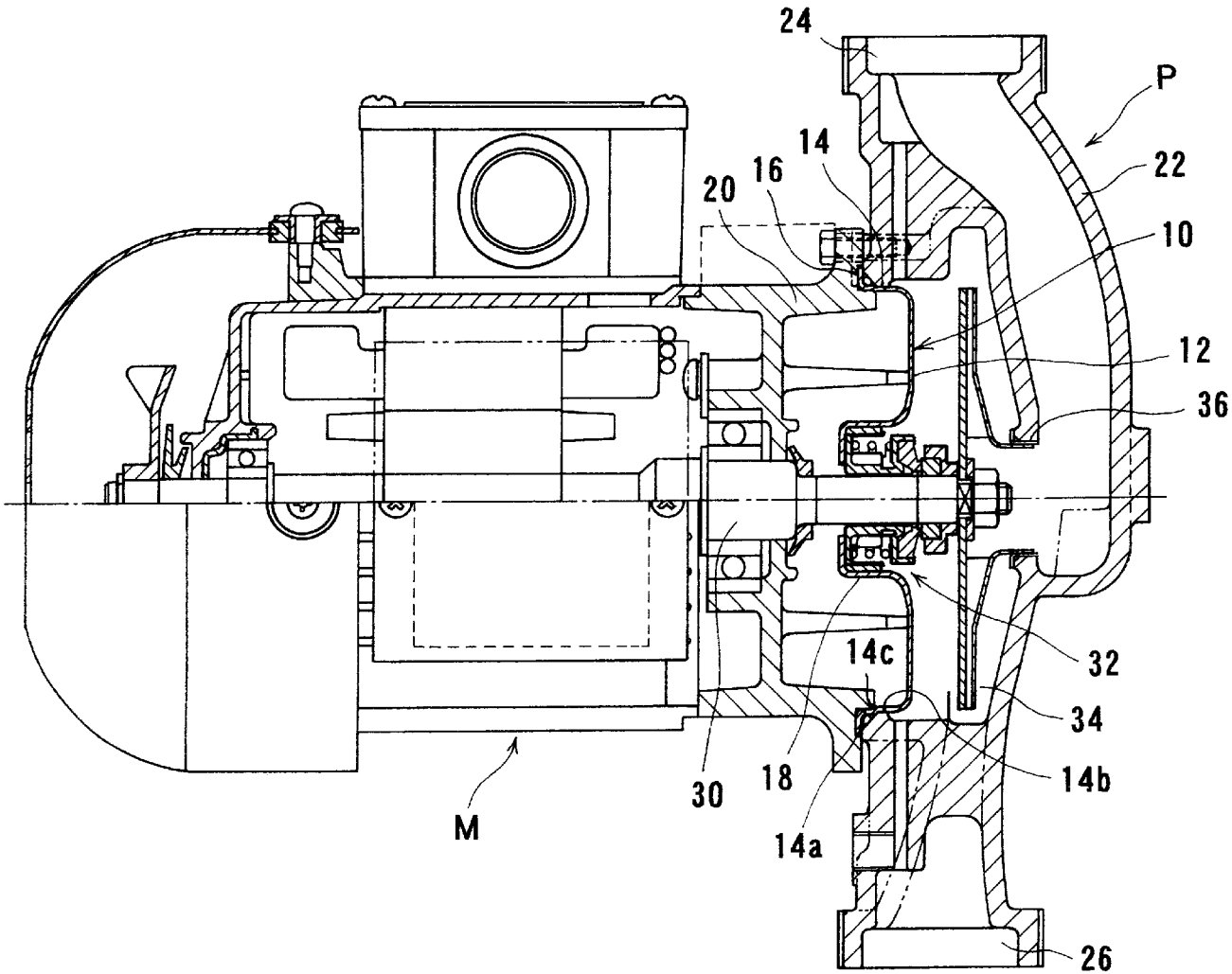
FIG. 2 is an axial cross-sectional view of a pump device according to an embodiment of the present invention.

As shown in FIGS. 2 and 3, a pump device according to an embodiment of the present invention has a motor assembly M and a pump assembly P. The motor assembly M has a high-pressure opening in which there is disposed a casing cover 10 that separates the motor assembly M and the pump assembly P from each other. The casing cover 10 has its circumferential edge gripped and secured in position between a motor bracket 20 that is mounted on an end of the motor assembly M closer to the pump assembly P and a pump casing 22 of the pump assembly P.

The motor assembly M has a main shaft 30 extending toward the pump assembly P. The main shaft 30 is sealed by a mechanical seal 32 mounted on an inner circumferential surface of the casing cover 10 and extends into the pump casing 22. An impeller 34 is fixed to the end of the main shaft 30 which is positioned in the pump casing 22.

The pump casing 22 has a suction port 24 defined in one end thereof and a discharge port 26 defined in the other end thereof. A liner ring 36 is fixed, as by pressing, to an end face of the pump casing 22 which surrounds an outer circumferential surface of a suction end of the impeller 34. With the liner ring 36 being thus positioned, there is defined a restriction between the outer circumferential surface of the suction end of the impeller 34 and an inner circumferential surface of the liner ring 36. The restriction has a given gap and separates a higher-pressure region and a lower-pressure region within the pump casing 22.

When the motor assembly M is energized, the impeller 34 disposed in the pump casing 22 rotates in unison with the main shaft 30, drawing a liquid which is being handled from the suction port 24 into the pump casing 22. The liquid drawn into the pump casing 22 is then pressurized by the impeller 34, and then discharged out of the pump casing 22 through the discharge port 26.

The casing cover 10 comprises a press-formed product that is formed by pressing a stainless steel plate, for example, and has a flat panel portion 12, a cylindrical wall portion 14, a flange portion 16, and a mechanical seal holder portion 18 which holds the mechanical seal 32 therein. The cylindrical wall portion 14 has an annular step 14*c* positioned somewhere in the axial longitudinal direction of the cylindrical wall portion 14. The cylindrical wall portion 14 includes a larger-diameter region on one side of the annular step 14*c,* i.e., closer to the motor assembly M, and a smaller-diameter region on the other side of the annular step 14*c,* i.e., closer to the pump assembly P. The cylindrical wall portion 14 also has a motor-side faucet-joint surface (motor-side positioning portion) 14*a,* i.e. the motor-side register fit surface 14*a,* on its inner circumferential surface which is fitted over the motor bracket 20 and a pump-side faucet-joint surface (pump-side positioning portion) 14*b,* i.e. the pump-side register fit surface 14*b,* on its outer circumferential surface which is fitted in the pump casing 22, thus providing a faucet-joint structure, i.e. a socket-and-spigot joint (positioning) structure. The motor-side faucet-joint surface 14*a* and the pump-side faucet-joint surface 14*b* are disposed respectively in the larger-diameter region and the smaller-diameter region, i.e., respectively on the opposite sides of the annular step 14*c*.

The casing cover 10 is disposed securely in position between the motor bracket 20 and the pump casing 22, with the motor-side faucet-joint surface 14*a* being held in interfitting faucet-joint engagement with the motor bracket 20 and the pump-side faucet-joint surface 14*b* being held in interfitting faucet-joint engagement with the pump casing 22. Therefore, accurate positioning of the motor bracket 20 and the pump casing 22 is obtained through the motor-side faucet-joint surface 14*a* and the pump-side faucet-joint surface 14*b* of the casing cover 10.

Since the motor-side faucet-joint surface (motor-side positioning portion) 14*a* and the pump-side faucet-joint surface (pump-side positioning portion) 14*b* are individually positioned one on each side of the annular step 14*c* of the cylindrical wall portion 14, the casing cover 10 can be formed by pressing the flat plate using both the motor-side faucet-joint surface 14*a* and the pump-side faucet-joint surface 14*b* as dimensional references. Specifically, the smaller-diameter region of the cylindrical wall portion 14 on one side of the annular step 14*c* is formed using the pump-side faucet-joint surface 14*b* or the outer circumferential surface as a dimensional reference, and the larger-diameter region of the cylindrical wall portion 14 on the other side of the annular step 14*c* is formed using the motor-side faucet-joint surface 14*a* or the inner circumferential surface as a dimensional reference. Accordingly, both the motor-side faucet-joint surface 14*a* and the pump-side faucet-joint surface 14*b* can be pressed to shape with high dimensional accuracy. The casing cover 10 with such high dimensional accuracy can be assembled easily and quickly in the motor bracket 20 and the pump casing 22.

When the pump device is serviced for maintenance, e.g., when the mechanical seal 32 is replaced, even if the casing cover 10 sticks to the motor bracket 20 and the pump casing 22 due to rust or the like, the casing cover 10 can be removed while the pump-side faucet-joint surface 14*b* or the outer circumferential surface of the cylindrical wall portion 14 on one side of the annular step 14*c* is being dimensionally maintained, and the motor-side faucet-joint surface 14*a* or the inner circumferential surface of the cylindrical wall portion 14 on the other side of the annular step 14*c* is being dimensionally maintained. Therefore, the casing cover 10 can be reassembled easily and quickly in the motor bracket 20 and the pump casing 22.

According to the present invention, as described above, the casing cover 10 is capable of fitting with the motor bracket 20 and the pump casing 22 highly accurately in providing a faucet-joint (positioning) structure, and of disassembling and removing the cylindrical wall portion 14 held in interfitting faucet-joint engagement with the motor bracket 20 and the pump casing 22 while keeping normal dimensions and also reassembling the cylindrical wall portion 14 easily and quickly.

Although a certain preferred embodiment of the present invention has been shown and described in detail, it should be understood that various changes and modifications may be made therein without departing from the scope of the appended claims.

What is claimed is:

1. A casing cover for use in separating a motor assembly and a pump assembly from each other in a pump device, comprising:

a cylindrical wall portion having a step, a motor-side positioning portion positioned on one side of said step for being fitted to a member of the motor assembly, and a pump-side positioning portion positioned on the other side of said step for being fitted to a member of the pump assembly.

2. The casing cover according to claim 1, wherein said motor-side positioning portion comprises a motor-side faucet-joint surface, and said pump-side positioning portion comprises a pump-side faucet-joint surface, thereby providing a faucet-joint structure.

3. The casing cover according to claim 2, wherein said motor-side faucet-joint surface is disposed on one of an inner and outer circumferential surface of the cylindrical wall portion, and said pump-side faucet-joint surface is disposed on the other of the inner and outer circumferential surface of the cylindrical wall portion.

4. A pump device comprising:

a motor assembly;

a pump assembly; and a casing cover separating said motor assembly and said pump assembly from each other;

said casing cover comprising a cylindrical wall portion having a step, a motor-side positioning portion positioned on one side of said step for being fitted to a member of the motor assembly, and a pump-side positioning portion positioned on the other side of said step for being fitted to a member of the pump assembly.

5. The pump device according to claim 4, wherein said motor-side positioning portion comprises a motor-side faucet-joint surface, and said pump-side positioning portion comprises a pump-side faucet-joint surface, thereby providing a faucet-joint structure.

6. The pump device according to claim 5, wherein said motor-side faucet-joint surface is disposed on one of an inner and outer circumferential surface of the cylindrical wall portion, and said pump-side faucet-joint surface is disposed on the other of the inner and outer circumferential surface of the cylindrical wall portion.

* * * * *